US010551770B1

(12) United States Patent
Seko et al.

(10) Patent No.: US 10,551,770 B1
(45) Date of Patent: Feb. 4, 2020

(54) TRANSFER DEVICE AND IMAGE-FORMING APPARATUS

(71) Applicant: FUJI XEROX CO., LTD., Tokyo (JP)

(72) Inventors: Masayuki Seko, Kanagawa (JP); Masato Ono, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/297,728

(22) Filed: Mar. 11, 2019

(30) Foreign Application Priority Data

Sep. 26, 2018 (JP) ..... 2018-179869

(51) Int. Cl.
*G03G 15/16* (2006.01)

(52) U.S. Cl.
CPC ..... *G03G 15/162* (2013.01); *G03G 15/1685* (2013.01)

(58) Field of Classification Search
CPC ..... G03G 15/162; G03G 15/1685
See application file for complete search history.

(56) References Cited

U.S. PATENT DOCUMENTS 5,572,304 A * 11/1996 Seto ..... G03G 7/0006 399/313
6,173,148 B1 * 1/2001 Matsuda ..... G03G 15/1685 399/310
7,693,438 B2 * 4/2010 Kyung ..... G03G 15/161 399/45
8,126,342 B2 * 2/2012 Gibson ..... G03G 15/1605 399/308

FOREIGN PATENT DOCUMENTS

JP 2003280409 A * 10/2003
JP 2010197961 9/2010

* cited by examiner

*Primary Examiner* — Walter L Lindsay, Jr.
*Assistant Examiner* — Arlene Heredia
(74) *Attorney, Agent, or Firm* — JCIPRNET

(57) ABSTRACT

A transfer device includes an intermediate transfer belt having a surface that receives a toner image, a support roller supporting the intermediate transfer belt, and a transfer unit that transfers the toner image from the intermediate transfer belt to a recording medium. The transfer unit includes a transfer belt and a transfer roller disposed opposite the support roller with the transfer belt and the intermediate transfer belt therebetween. The transfer roller has a volume resistance value of one-tenth or less of a system resistance value for a current of 120 μA between the support roller and the transfer roller.

9 Claims, 2 Drawing Sheets

TRANSFER DEVICE AND IMAGE-FORMING APPARATUS

CROSS-REFERENCE TO RELATED APPLICATIONS

This application is based on and claims priority under 35 USC 119 from Japanese Patent Application No. 2018-179869 filed Sep. 26, 2018.

BACKGROUND

(i) Technical Field

The present disclosure relates to transfer devices and image-forming apparatuses.

(ii) Related Art

An electrophotographic image-forming apparatus known in the related art forms an electrostatic latent image on an image carrier such as an electrophotographic photoreceptor, develops the electrostatic latent image with a toner, electrostatically transfers the resulting toner image to an intermediate transfer belt that is an endless belt (first transfer step), and transfers the toner image to a recording medium such as a sheet of paper (second transfer step) to form an image on the recording medium. Such a system in which an image is transferred to a recording medium via an intermediate transfer belt is suitable for use in an image-forming apparatus in which a plurality of toner images of different colors are superimposed on top of each other on an intermediate transfer belt by a plurality of image carriers to obtain a full-color image (tandem system).

Japanese Unexamined Patent Application Publication No. 2010-197961 discloses a transfer device including a first transfer section that performs first transfer of a toner image formed on an image carrier to an intermediate transfer member, a support member supporting the intermediate transfer member, and a second transfer section including a second transfer member disposed opposite the support member with the intermediate transfer member therebetween. A second transfer electric field is formed between the second transfer member and the support member to perform second transfer of the toner image that has been subjected to first transfer to the intermediate transfer member to a recording medium. Once the type of recording medium is set, the transfer device applies a predetermined second transfer voltage to the second transfer section depending on that setting. The effective resistance values of the support member, the intermediate transfer member, and the second transfer member in the passage and non-passage areas of a second transfer nip during the application of the second transfer voltage satisfy one of conditions (1) and (2):

effective resistance value of intermediate transfer member<effective resistance value of second transfer member (1)

effective resistance value of second transfer member<effective resistance value of support member<effective resistance value of intermediate transfer member (2)

In the related art, there are situations where a transfer current flowing from a passage area to a non-passage area in a transfer step degrades part of a transfer roller and a transfer belt of a transfer unit forming a transfer device (i.e., the ends of the transfer roller and the transfer belt in a direction crossing the passage direction of recording media). When the width of recording media is changed in such situations, poor transfer may occur at the ends of recording media in the direction crossing the passage direction of recording media (hereinafter also simply referred to as "the ends of recording media") (hereinafter also referred to as "poor end transfer"). In particular, such poor end transfer may occur after switching from continuous transfer to narrow recording media to transfer to wide recording media.

SUMMARY

Aspects of non-limiting embodiments of the present disclosure relate to a transfer device with a reduced likelihood of poor transfer at the ends of recording media as compared to a transfer device including a transfer roller having a volume resistance value of more than one-tenth of a system resistance value for a current of 120 μA between a support roller and the transfer roller.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a transfer device comprising an intermediate transfer belt having a surface that receives a toner image, a support roller supporting the intermediate transfer belt, and a transfer unit that transfers the toner image from the intermediate transfer belt to a recording medium. The transfer unit comprises a transfer belt and a transfer roller disposed opposite the support roller with the transfer belt and the intermediate transfer belt therebetween. The transfer roller has a volume resistance value of one-tenth or less of a system resistance value for a current of 120 μA between the support roller and the transfer roller.

BRIEF DESCRIPTION OF THE DRAWINGS

An exemplary embodiment of the present disclosure will be described in detail based on the following figures, wherein.

DETAILED DESCRIPTION

Figure 1:
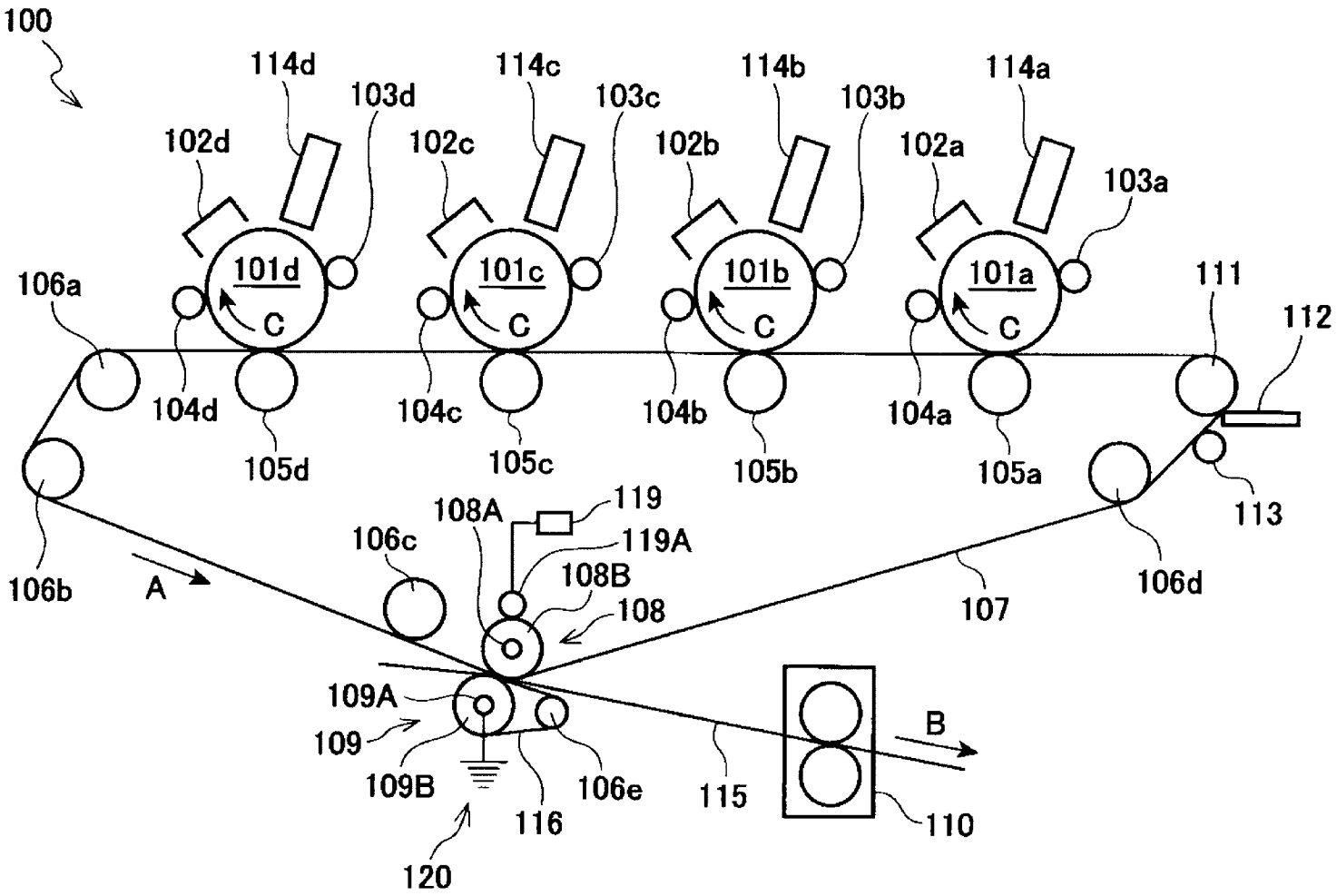
FIG. 1 is a schematic configuration view showing an image-forming apparatus according to the exemplary embodiment.

An exemplary embodiment serving as an example of the present disclosure will hereinafter be described in detail.

A transfer device according to the exemplary embodiment comprises an intermediate transfer belt having a surface that receives a toner image, a support roller supporting the intermediate transfer belt, and a transfer unit that transfers the toner image from the intermediate transfer belt to a recording medium. The transfer unit comprises a transfer belt and a transfer roller disposed opposite the support roller with the transfer belt and the intermediate transfer belt therebetween. The transfer roller has a volume resistance value of one-tenth or less of a system resistance value for a current of 120 μA between the support roller and the transfer roller.

The foregoing configuration may allow the transfer device according to the exemplary embodiment to have a reduced likelihood of poor transfer at the ends of recording media.

Although the mechanism is not fully understood, a possible explanation is as follows.

If the volume resistance value of the transfer roller is adjusted to one-tenth or less of the system resistance value for a current of 120 μA between the support roller and the transfer roller, a transfer current that flows into a non-passage area in a transfer step may have a reduced effect on the transfer roller and the transfer belt of the transfer unit. This may contribute to reduced degradation of the transfer roller and the transfer belt of the transfer unit during continuous transfer to narrow recording media.

As a result, poor transfer may be less likely to occur at the ends of recording media after switching from continuous transfer to narrow recording media to transfer to wide recording media.

Here, poor transfer tends to occur at the ends of recording media when a toner having a volume average particle size of 5.0 μm or less (particularly, 4.0 μm to 4.8 μm) is used. Accordingly, the transfer device according to the exemplary embodiment may be effective for use with a toner having a volume average particle size of 5.0 μm or less.

Here, the volume average particle size of a toner is measured with a COULTER MULTISIZER II (available from Beckman Coulter, Inc.) using ISOTON-II (available from Beckman Coulter, Inc.) as an electrolyte solution.

For measurement, 0.5 mg to 50 mg of a test specimen is added to 2 mL of a 5% aqueous solution of a surfactant (e.g., sodium alkylbenzenesulfonate) as a dispersant. The mixture is added to 100 mL to 150 mL of the electrolyte solution.

The electrolyte solution having the specimen suspended therein is subjected to dispersion treatment with an ultrasonic disperser for one minute. The particle size distribution of particles with particle sizes in the range of 2 μm to 60 μm is then measured with a COULTER MULTISIZER II having an aperture with an aperture size of 100 μm. 50,000 particles are sampled.

The measured particle size distribution is divided into particle size ranges (channels). A cumulative volume distribution is plotted against the particle size ranges from smaller particle sizes. The volume average particle size D50v is defined as the particle size where the cumulative percentage is 50%.

The exemplary embodiment will hereinafter be described in detail with reference to the drawings.

An image-forming apparatus according to the exemplary embodiment will now be described.

The image-forming apparatus according to the exemplary embodiment comprises an image carrier, a charging section that charges a surface of the image carrier, an electrostatic-charge-image forming section that forms an electrostatic charge image on the charged surface of the image carrier, a developing section that contains an electrostatic charge image developer and that develops the electrostatic charge image formed on the surface of the image carrier with the electrostatic charge image developer to form a toner image, a transfer section that transfers the toner image formed on the surface of the image carrier to a surface of a recording medium, and a fixing section that fixes the toner image transferred to the surface of the recording medium. The transfer section comprises the transfer device according to the exemplary embodiment.

FIG. 1 is a schematic configuration view showing the image-forming apparatus according to the exemplary embodiment. An image-forming apparatus 100 shown in FIG. 1 is an example (an exemplary embodiment) of the overall configuration of an image-forming apparatus comprising the transfer device according to the exemplary embodiment as a second transfer device.

Figure 2:
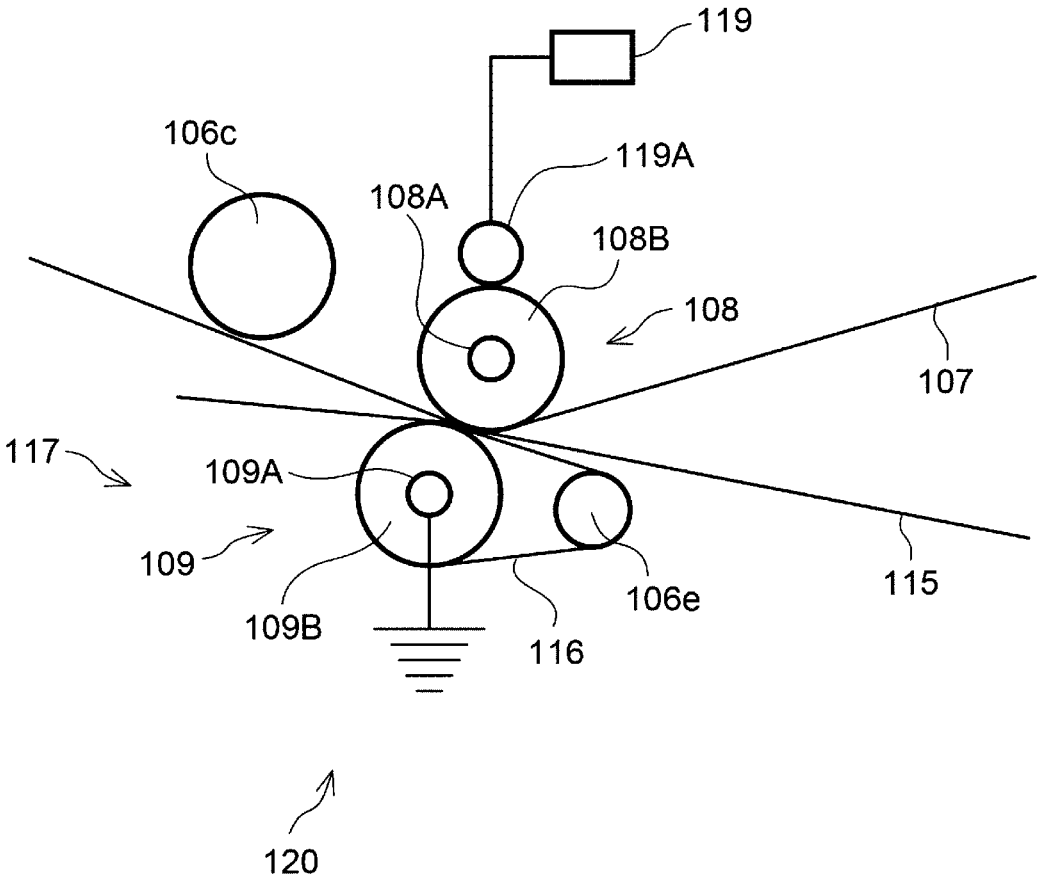
FIG. 2 is a schematic configuration view showing a portion around a second transfer device of the image-forming apparatus shown in FIG. 1.

FIG. 2 is a schematic configuration view showing the portion around the second transfer device of the image-forming apparatus shown in FIG. 1.

As shown in FIG. 1, the image-forming apparatus 100 according to the exemplary embodiment is a so-called tandem system, including four image carriers 101*a* to 101*d* comprising electrophotographic photoreceptors. Around the image carriers 101*a* to 101*d* are arranged, in order in the rotational direction, charging devices 102*a* to 102*d* (an example of a charging section), exposure devices 114*a* to 114*d* (an example of an electrostatic-charge-image forming section), developing devices 103*a* to 103*d* (an example of a developing section), first transfer rollers 105*a* to 105*d*, and image-carrier cleaning devices 104*a* to 104*d*. The image-forming apparatus 100 may include erase devices that eliminate any residual potential from the surfaces of the image carriers 101*a* to 101*d* after transfer.

The image-forming apparatus 100 includes an intermediate transfer belt 107. The intermediate transfer belt 107 is stretched around tension rollers 106*a* to 106*d*, a drive roller 111, and a backup roller 108 (an example of a support roller), thus forming an annular-member stretching device (belt-stretching device). The intermediate transfer belt 107 is transported by the tension rollers 106*a* to 106*d*, the drive roller 111, and the backup roller 108 between the image carriers 101*a* to 101*d* and the first transfer rollers 105*a* to 105*d* in the direction indicated by the arrow A while being in contact with the surfaces of the image carriers 101*a* to 101*d*.

The first transfer rollers 105*a* to 105*d* are disposed in contact with the inner circumferential surface of the intermediate transfer belt 107 such that the intermediate transfer belt 107 is held between the first transfer rollers 105*a* to 105*d* and the image carriers 101*a* to 101*d*, respectively. The areas where the first transfer rollers 105*a* to 105*d* are disposed opposite the image carriers 101*a* to 101*d*, respectively, serve as first transfer areas (first transfer nips). The first transfer rollers 105*a* to 105*d* apply a first transfer current to the first transfer areas, thereby transferring toner images carried on the image carriers 101*a* to 101*d* to the intermediate transfer belt 107.

The image-forming apparatus 100 includes a second transfer device 120 downstream of the image carrier 101*d* in the transport direction of the intermediate transfer belt 107. The second transfer device 120 includes a drive roller 109 (an example of a transfer roller), the backup roller 108, a contact roller 119A, a second transfer belt 116 (an example of a transfer belt), a second-transfer-bias constant-voltage current-applying unit 119, and a drive unit (not shown). The second transfer device 120 will be described in detail later.

A device including the first transfer rollers 105*a* to 105*d* and the second transfer device 120 corresponds to an example of a transfer section.

In the second transfer device 120, the backup roller 108 and the second transfer belt 116 are disposed opposite each other with the intermediate transfer belt 107 therebetween. The intermediate transfer belt 107 and the second transfer belt 116 rotate in opposite directions so that a sheet of recording paper 115 (an example of a recording medium) is held therebetween. The recording paper 115 is held and transported between the intermediate transfer belt 107 and the second transfer belt 116 in the direction indicated by the arrow B and is then transported through a fixing device 110.

Here, the area where the drive roller 109 is disposed opposite the backup roller 108 with the intermediate transfer belt 107 and the second transfer belt 116 therebetween serves as a second transfer area (second transfer nip). A voltage is applied to the contact roller 119A to form a second transfer electric field between the backup roller 108 and the drive roller 109, with its shaft grounded. In addition, intermediate-transfer-belt cleaning devices 112 and 113 are disposed in contact with the intermediate transfer belt 107 after the second transfer.

In the thus-configured full-color image-forming apparatus 100, the image carrier 101*a* rotates in the direction indicated by the arrow C. After the surface of the image carrier 101*a* is charged by the charging device 102*a*, an electrostatic latent image for the first color is formed by the exposure device 114*a*, for example, with laser light. The resulting electrostatic latent image is developed (made visible) by the developing device 103*a*, which contains a toner of that color, with the toner to form a toner image. The developing devices 103*a* to 103*d* contain toners of different colors (e.g., yellow, magenta, cyan, and black) corresponding to electrostatic latent images.

As the toner image formed on the image carrier 101*a* is transported through the first transfer area, the first transfer roller 105*a* electrostatically transfers the toner image to the intermediate transfer belt 107 (first transfer). Thereafter, the first transfer rollers 105*b* to 105*d* successively perform first transfer of toner images of the second, third, and fourth colors to the intermediate transfer belt 107 having the toner image of the first color supported thereon such that the toner images are superimposed on top of each other. A full-color combined toner image is finally obtained.

As the toner image formed on the intermediate transfer belt 107 is transported through the second transfer area, the toner image is simultaneously electrostatically transferred to the recording paper 115 (second transfer). The recording paper 115 having the toner image transferred thereto is transported to the fixing device 110 (an example of a fixing section). After the toner image is subjected to fixing treatment by at least one of heating and pressing, the recording paper 115 is output from the image-forming apparatus 100.

After the first transfer, any residual toner is removed from the image carriers 101*a* to 101*d* by the image-carrier cleaning devices 104*a* to 104*d*. On the other hand, after the second transfer, any residual toner is removed from the intermediate transfer belt 107 by the intermediate-transfer-belt cleaning devices 112 and 113 to prepare for the next image-forming process.

The individual components of the image-forming apparatus 100 will hereinafter be described. In the following, components (members) having the same functions are described without the characters a to d. For example, when the image carriers 101*a* to 101*d* are collectively mentioned, they are described as "image carriers 101".

Image Carriers

A wide variety of known electrophotographic photoreceptors may be used as the image carriers 101. Examples of electrophotographic photoreceptors include inorganic photoreceptors, which have photosensitive layers formed of inorganic materials, and organic photoreceptors, which have photosensitive layers formed of organic materials. Examples of organic photoreceptors include separated-function organic photoreceptors, which have a charge generation layer that generates a charge upon exposure and a charge transport layer that transports the charge, and single-layer organic photoreceptors, which have a single layer that offers both a charge generation function and a charge transport function. Examples of inorganic photoreceptors include those having photosensitive layers formed of amorphous silicon. The image carriers 101 may have any shape. For example, known shapes such as cylindrical drums, sheets, and plates may be employed.

Image-Carrier Cleaning Devices

The image-carrier cleaning devices 104 are intended to remove any residual toner deposited on the surfaces of the image carriers 101 after the first transfer step. Cleaning blades and other members such as cleaning brushes and cleaning rollers may be used. Examples of materials for cleaning blades include urethane rubber, neoprene rubber, and silicone rubber.

Charging Devices

The charging devices 102 may be any type of charging device. For example, a wide variety of known charging devices may be used, including contact charging devices having members such as conductive and semiconductive rollers, brushes, films, and rubber blades as well as scorotron charging devices and corotron charging devices, which utilize corona discharge. Of these, contact charging devices may generate less ozone and may allow for efficient charging.

Exposure Devices

The exposure devices 114 may be any type of exposure device. For example, a wide variety of known exposure devices may be used, including light sources such as semiconductor lasers, LEDs, and liquid crystal shutters and optical devices that expose the surfaces of the image carriers 101*a* to 101*d* to light from such light sources in the desired image pattern via polygon mirrors.

Developing Devices

The developing devices 103 contain developers containing toners and form toner images on the image carriers 101 with the developers.

The developing devices 103 are selected depending on the purpose. Examples of developing devices include known developing devices for development with one-component developers or two-component developers by contact with members such as brushes and rollers or without contact.

First Transfer Rollers

The first transfer rollers 105 may have a single-layer structure or a multilayer structure. If the first transfer rollers 105 have a single-layer structure, the first transfer rollers 105 may be composed of, for example, a roller formed of a rubber material, such as foamed or unfoamed silicone rubber, urethane rubber, or EPDM, that contains a suitable amount of a conductor such as carbon black. For example, a current of 30 μA to 100 μA is applied to the first transfer rollers 105 to form an electric field between the first transfer rollers 105 and the image carriers 101, thereby transferring the toner images carried on the image carriers 101 to the intermediate transfer belt 107.

Intermediate Transfer Belt 107

The intermediate transfer belt 107 may be, for example, a semiconductive belt formed of a thermoplastic resin, such as a polycarbonate resin, a polyvinylidene fluoride resin, a polyalkylene phthalate resin, a polycarbonate/polyalkylene phthalate blend, or an ethylene-tetrafluoroethylene copolymer, or a thermosetting resin, such as polyimide or a copolymer of polyimide and polyamide, that contains a conductor (e.g., carbon black).

The intermediate transfer belt 107 may contain a release agent material such as fluorine-containing resin particles.

The intermediate transfer belt 107 may be a single-layer belt or a multilayer belt including a substrate and a release layer (a multilayer belt including two or more layers) with different resistances.

The intermediate transfer belt 107 preferably has a thickness of, for example, 0.05 mm to 0.5 mm, more preferably 0.06 mm to 0.10 mm, even more preferably 0.06 mm to 0.08 mm.

Intermediate-Transfer-Belt Cleaning Devices

Cleaning blades and other members such as cleaning brushes and cleaning rollers may be used as the intermediate-transfer-belt cleaning devices 112 and 113. Examples of materials for cleaning blades include urethane rubber, neoprene rubber, and silicone rubber.

Fixing Device

For example, a wide variety of known fixing devices may be used as the fixing device 110, including heat roller fixing devices, pressure roller fixing devices, and flash fixing devices.

Second Transfer Device

As shown in FIG. 2, the second transfer device 120 includes the intermediate transfer belt 107, the backup roller 108 (an example of a support roller), which supports the intermediate transfer belt 107, and a second transfer unit 117 (an example of a transfer unit). The second transfer device 120 further includes the contact roller 119A, which is disposed in contact with the backup roller 108, and the second-transfer-bias constant-voltage current-applying unit 119, which applies a second transfer voltage and current to the backup roller 108 via the contact roller 119A.

The second transfer unit 117 includes the second transfer belt 116 (an example of a transfer belt) and, inside the second transfer belt 116, the drive roller 109 (an example of a transfer roller) and an idler roller 106*e*. The drive roller 109 is disposed opposite the backup roller 108 with the intermediate transfer belt 107 and the second transfer belt 116 therebetween. The second transfer belt 116 is stretched between the drive roller 109 and the idler roller 106*e*.

The configurations of the backup roller 108, the drive roller 109, and the second transfer belt 116 of the second transfer device 120 will hereinafter be described in detail.

Backup Roller 108

The backup roller 108 functions as a counter electrode for the drive roller 109. The backup roller 108 is disposed opposite the drive roller 109 with the intermediate transfer belt 107 therebetween.

For example, the backup roller 108 is a cylindrical member disposed in contact with the inner circumferential surface of the intermediate transfer belt 107 such that the axial direction of the backup roller 108 is aligned with both the width direction of the intermediate transfer belt 107 and the axial direction of the drive roller 109.

The backup roller 108 includes, for example, a core 108A that is a metal shaft and a single-layer or multilayer conductive layer 108B disposed around the core 108A.

The core 108A is rotatably supported by a support (not shown). The support is rotated by an actuator (not shown) connected in signal communication with a controller (not shown) that controls the individual sections of the image-forming apparatus 100.

The conductive layer 108B is formed of a foam of a rubber material, such as silicone rubber, urethane rubber, ethylene-propylene-diene rubber (EPDM), acrylonitrile-butadiene copolymer rubber (NBR), or a rubber blend, that has a conductor such as carbon black dispersed therein.

If the conductive layer 108B has a double-layer structure, the conductive layer 108B may be composed of, for example, a layer formed of a rubber material as mentioned above and a surface layer covering the outer circumferential surface thereof.

Typically, a voltage is applied to the contact roller 119A so that a voltage of 0.1 kV to 15 kV is applied to the backup roller 108.

Drive Roller 109

The drive roller 109 is a cylindrical member disposed opposite the outer circumferential surface of the intermediate transfer belt 107 with the second transfer belt 116 therebetween such that the axial direction of the drive roller 109 is aligned with the width direction of the intermediate transfer belt 107.

The drive roller 109 includes, for example, a core 109A that is a metal shaft and a single-layer or multilayer conductive layer 109B disposed around the core 109A.

The core 109A is rotatably supported by a support (not shown). The support is rotated by an actuator (not shown) connected in signal communication with the controller (not shown) that controls the individual sections of the image-forming apparatus 100.

The conductive layer 109B is formed of a foam of a rubber material, such as silicone rubber, urethane rubber, ethylene-propylene-diene rubber (EPDM), acrylonitrile-butadiene copolymer rubber (NBR), or a rubber blend, that has a conductor such as carbon black dispersed therein.

If the conductive layer 109B has a double-layer structure, the conductive layer 109B may be composed of, for example, a layer formed of a rubber material as mentioned above and a surface layer covering the outer circumferential surface thereof.

The conductive layer 109B may have an Asker C hardness in the range of 15° to 50°. If the conductive layer 109B has an Asker C hardness in the range of 15° to 50°, the conductive layer 109B may be in stable contact with the intermediate transfer belt 107. The Asker C hardness is measured by pressing an indenter of an Asker C durometer (available from Kobunshi Keiki Co., Ltd.) against the surface of a test sheet with a thickness of 5 mm.

Here, the drive roller 109 and the backup roller 108 are disposed opposite each other with the intermediate transfer belt 107 and the second transfer belt 116 therebetween. The depth to which the drive roller 109 and the backup roller 108 are pressed against the intermediate transfer belt 107 is referred to as "biting depth". The biting depth may be adjusted depending on the recording paper 115. For example, if the recording paper 115 has a basis weight in the range of 60 to 186 g/m$^2$, the biting depth may be 0.9 mm, whereas if the recording paper 115 has a basis weight of 187 g/m$^2$ or more, the biting depth may be 0.3 mm. The angle of wrap around the drive roller 109 and the backup roller 108 may be set to around 27°.

The adjustment of the biting depth is performed, for example, by adjusting the distance between the drive roller 109 and the backup roller 108 by the movement of the drive roller 109 depending on the type of recording paper 115.

Second Transfer Belt 116

The second transfer belt 116 is stretched between the drive roller 109 and the idler roller 106*e*. By rotating in the opposite direction to the intermediate transfer belt 107, the second transfer belt 116 functions to perform second transfer of a toner image from the intermediate transfer belt 107 to the recording paper 115 in the second transfer nip while transporting the recording paper 115 in the direction toward the fixing device 110.

Here, friction occurs between the second transfer belt 116 and the intermediate transfer belt 107 in the second transfer nip.

Accordingly, if the intermediate transfer belt 107 is a belt formed of a resin, such as polyimide, that has a conductor such as carbon black dispersed therein, the second transfer belt 116 may be an elastic belt formed of a rubber material, such as silicone rubber, urethane rubber, or chloroprene rubber, that has a conductor such as carbon black dispersed therein.

Conversely, if the intermediate transfer belt 107 is an elastic belt formed of a rubber, such as silicone rubber, urethane rubber, or chloroprene rubber, that has a conductor such as carbon black dispersed therein, the second transfer belt 116 may be a belt formed of a resin, such as polyimide, that has a conductor such as carbon black dispersed therein.

Relationship between Drive Roller 109 and System resistance Value of Second Transfer Device 120

The drive roller 109 of the second transfer device 120 has a volume resistance value of one-tenth or less of the system resistance value of the second transfer device 120.

Whereas the drive roller 109 has a volume resistance value of one-tenth or less of the system resistance value of the second transfer device 120, the drive roller 109 preferably has a volume resistance value of one-fiftieth or less, more preferably one-hundredth or less, of the system resistance value to achieve a reduced likelihood of poor transfer at the ends of recording media.

From the viewpoint of the drive performance of the second transfer belt 116, the drive roller 109 may have a volume resistance value of one-thousandth or more of the system resistance value of the second transfer device 120.

The above relationship between the volume resistance value of the drive roller 109 and the system resistance value of the second transfer device 120 may be achieved, for example, by increasing the amount of conductor added to the conductive layer 109B of the drive roller 109.

Here, the system resistance value of the second transfer device 120 is the system resistance value for a current of 120 μA between the backup roller 108 and the drive roller 109. Specifically, the system resistance value is measured as follows.

The second transfer device under measurement is equipped with the intermediate transfer belt 107, the backup roller 108, and the second transfer unit 117. A direct current I of 120 μA is supplied between the core 108A of the backup roller 108 and the core 109A of the drive roller 109 of the second transfer unit 117. The voltage V is measured 10 seconds after energization is started. The resistance value calculated by the formula "resistance value R=V/I" is employed as the system resistance value (R).

The measurement conditions are as follows: an environment with a temperature of 22° C. and a humidity of 55% RH, and a second transfer nip width of 2 mm.

The second transfer nip width is the contact width between the intermediate transfer belt 107 and the second transfer belt 116 in the belt circumferential direction.

The system resistance value is preferably 5.5 log Ω to 8.0 log Ω, more preferably 6.0 log Ω to 7.5 log Ω, even more preferably 6.5 log Ω to 7.0 log Ω.

If the system resistance value is 8.0 log Ω or less, image degradation due to discharge of the transfer current in the transfer step may be less likely to appear, and the members forming the second transfer device 120 may be less likely to deteriorate. On the other hand, if the system resistance value is 5.5 log Ω or more, the resistance of the recording paper 115 passing through the second transfer device 120 may have less effect on transfer, thus resulting in stable transfer performance.

The drive roller 109 preferably has a volume resistance value of 3.5 log Ω or more, more preferably 4.0 log Ω or more. On the other hand, the drive roller 109 preferably has a volume resistance value of 7.0 log Ω or less, more preferably 5.5 log Ω or less, even more preferably 5.2 log Ω or less, particularly preferably 4.4 log Ω or less.

If the drive roller 109 has a volume resistance value of 3.5 log Ω or more, the drive roller 109 may have a tendency to maintain suitable elasticity, thus resulting in less decrease in transfer performance. On the other hand, if the drive roller 109 has a volume resistance value of 7.0 log Ω or less, poor transfer may be less likely to occur at the ends of the recording paper 115.

Here, the volume resistance value of the drive roller 109 is measured as follows.

The drive roller 109 under measurement is placed on a metal plate in an environment with a temperature of 22° C. and a humidity of 55% RH. A load of 500 g is applied to both ends of the core 109A of the drive roller 109 toward the metal plate side. In this state, a direct current I of 120 μA is supplied between the core 109A of the drive roller 109 and the metal plate. The voltage V is measured 10 seconds after energization is started. The resistance value calculated by the formula "resistance value R=V/I" is employed as the volume resistance value (R) of the drive roller 109.

The image-forming apparatus according to the exemplary embodiment described above is an example where the transfer device according to the exemplary embodiment is used as a second transfer device. It should be understood that various modifications can be made without departing from the spirit of the exemplary embodiment.

For example, the image-forming apparatus according to the exemplary embodiment may be a triple- or multiple-transfer image-forming apparatus that transfers toner images three or more times. In this image-forming apparatus, the transfer device according to the exemplary embodiment may be used as a third or any subsequent transfer device that transfers toner images to recording media.

EXAMPLES

The exemplary embodiment will hereinafter be described in more detail with reference to the following examples and comparative examples, although these examples are not intended to limit the exemplary embodiment in any way. Parts and percentages are by mass unless otherwise specified.

Example 1

In this example, an Iridesse™ Production Press available from Fuji Xerox Co., Ltd. is modified by attaching an intermediate transfer belt, a backup roller (an example of a support roller), a second transfer belt (an example of a transfer belt), and a drive roller (an example of a transfer roller) to a section corresponding to a second transfer device. The individual members are brought into press contact with each other such that the second transfer nip width is 2.0 mm.

The modified apparatus is configured such that the individual sections of the apparatus are controlled to rotate the intermediate transfer belt at a speed of 530 mm/s.

The individual members of the second transfer device used for the modified apparatus are as follows.

The intermediate transfer belt is a polyimide belt having a double-layer structure including an innermost layer with a thickness of 35 μm and an outermost layer with a thickness of 65 μm.

The backup roller (an example of a support roller) has a diameter of 28 mm and includes a metal core and a semi-conductive EPDM/NBR blend layer (conductive layer) formed on the outer circumferential surface of the metal core and having a carbon conductor dispersed therein. The hardness of the EPDM/NBR blend layer measured with an Asker C durometer is adjusted to 53°.

The second transfer belt includes a substrate layer formed of a chloroprene/EPDM blend having conductive carbon black dispersed therein and a coating layer (surface layer) formed on the surface of the substrate layer from a urethane emulsion having polytetrafluoroethylene (PTFE) particles dispersed therein.

The drive roller (an example of a transfer roller) has a diameter of 28 mm and includes a metal core and a semi-conductive EPDM layer (conductive layer) formed on the outer circumferential surface of the metal core and having a carbon conductor dispersed therein. The amount of carbon conductor in the semiconductive EPDM layer (conductive layer) is adjusted so that the drive roller has a volume resistance value (initial resistance) of 5.3 log Ω.

The toner is prepared by an emulsion polymerization aggregation process so that the volume average particle size is adjusted to 4.8 μm and the shape factor is adjusted to 120 to 140.

Transfer Performance Evaluation

The resulting modified apparatus is used to continuously print blue solid images on sheets of thick paper (with a basis weight of 216 g/m$^2$) under the following conditions: an environment with low humidity (15%) and low temperature (10° C.), a second transfer current of 120 μA, and an intermediate transfer belt rotational speed of 530 mm/s. The blue solid images after printing on 100 sheets (initial) and after printing on 80,000 sheets (after 80 kPV) are visually examined and are rated for initial transfer performance and transfer performance after 80 kPV on the following scale. The results are summarized in Table 1.

A: There is no poor transfer on the recording medium.

B: There is poor transfer only at the ends of the recording medium.

C: There is poor transfer over the entire surface of the recording medium.

Examples 2 to 6 and Comparative Examples 1 and 2

The same procedure as in Example 1 is performed except that the amount of carbon conductor present in the semi-conductive EPDM layer (conductive layer) of the drive roller is adjusted so that the volume resistance value of the drive roller is as shown in Table 1, and the amounts of carbon conductor in the backup roller and the second transfer belt or other factors are adjusted so that the system resistance value is as shown in Table 1.

Comparative Example 3

The same procedure as in Example 1 is performed except that the toner has a volume average particle size of 5.2 μm, and the amounts of carbon conductor in the backup roller and the second transfer belt or other factors are adjusted so that the system resistance value is as shown in Table 1.

TABLE 1

| | System resistance value (log Ω) | Volume resistance value of drive roller (log Ω) | Volume average particle size of toner (μm) | Transfer performance evaluation | |
|---|---|---|---|---|---|
| | | | | Initial | After 80 kPV |
| Example 1 | 6.3 | 5.3 | 4.8 | A | A |
| Example 2 | 6.2 | 4.9 | 4.8 | A | A |
| Example 3 | 6.3 | 4.5 | 4.8 | A | A |
| Example 4 | 8.0 | 6.9 | 4.8 | A | A |
| Example 5 | 7.9 | 4.9 | 4.8 | A | A |
| Example 6 | 5.6 | 4.5 | 4.8 | A | A |
| Comparative Example 1 | 6.4 | 6.0 | 4.8 | A | C |
| Comparative Example 2 | 5.8 | 4.9 | 4.8 | A | C |
| Comparative Example 3 | 6.2 | 5.3 | 5.2 | A | B |

The Examples, in which the drive roller (an example of a transfer roller) has a volume resistance value of one-tenth or less of the system resistance value, show no poor transfer on the recording media. In contrast, the Comparative Examples, in which the drive roller (an example of a transfer roller) has a volume resistance value of more than one-tenth of the system resistance value, show poor transfer at the ends of or over the entire surfaces of the recording media.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transfer device comprising:

an intermediate transfer belt having a surface that receives a toner image;

a support roller supporting the intermediate transfer belt; and a transfer unit that transfers the toner image from the intermediate transfer belt to a recording medium, the transfer unit comprising a transfer belt and a transfer roller disposed opposite the support roller with the transfer belt and the intermediate transfer belt therebetween, wherein the transfer roller has a volume resistance value of one-tenth or less of a system resistance value for a current of 120 μA between the support roller and the transfer roller.

2. The transfer device according to claim 1, wherein the system resistance value is 5.5 log Ω to 8.0 log Ω.

3. The transfer device according to claim 2, wherein the system resistance value is 6.0 log Ω to 7.5 log Ω.

4. The transfer device according to claim 2, wherein the transfer roller has a volume resistance value of 3.5 log Ω or more.

5. The transfer device according to claim 4, wherein the transfer roller has a volume resistance value of 7.0 log Ω or less.

6. The transfer device according to claim 4, wherein the transfer roller has a volume resistance value of 4.0 log Ω or more.

7. The transfer device according to claim 6, wherein the transfer roller has a volume resistance value of 5.5 log Ω or less.

8. An image-forming apparatus comprising:

an image carrier;

a charging section that charges a surface of the image carrier;

an electrostatic-charge-image forming section that forms an electrostatic charge image on the charged surface of the image carrier;

a developing section that develops the electrostatic charge image formed on the surface of the image carrier with an electrostatic charge image developer to form a toner image;

a transfer section that transfers the toner image formed on the surface of the image carrier to a surface of a recording medium, the transfer section comprising the transfer device according to claim 1; and a fixing section that fixes the toner image transferred to the surface of the recording medium.

9. An image-forming apparatus comprising:

an image carrier;

charging means for charging a surface of the image carrier;

electrostatic-charge-image forming means for forming an electrostatic charge image on the charged surface of the image carrier;

developing means for developing the electrostatic charge image formed on the surface of the image carrier with an electrostatic charge image developer to form a toner image;

transfer means for transferring the toner image formed on the surface of the image carrier to a surface of a recording medium, the transfer means comprising the transfer device according to claim 1; and fixing means for fixing the toner image transferred to the surface of the recording medium.

* * * * *